US012590500B2

(12) United States Patent
McClure et al.

(10) Patent No.: US 12,590,500 B2
(45) Date of Patent: Mar. 31, 2026

(54) EXTENDED REACH AND JARRING TOOL FOR A BOTTOM HOLE ASSEMBLY

(71) Applicant: KLX ENERGY SERVICES LLC, Houston, TX (US)

(72) Inventors: John D. McClure, Magnolia, TX (US); Robert Stratton, Tomball, TX (US); Ryan Nyberg, Houston, TX (US); Cynthia Aguilera, Humble, TX (US); Chris Hughes, Houston, TX (US)

(73) Assignee: KLX ENERGY SERVICES LLC, Houston, TX (US)

( * ) Notice: Subject to any disclaimer, the term of this patent is extended or adjusted under 35 U.S.C. 154(b) by 45 days.

(21) Appl. No.: 18/375,811

(22) Filed: Oct. 2, 2023

(65) Prior Publication Data

US 2024/0117697 A1 Apr. 11, 2024

Related U.S. Application Data

(60) Provisional application No. 63/526,881, filed on Jul. 14, 2023, provisional application No. 63/413,775, filed on Oct. 6, 2022.

(51) Int. Cl.
*E21B 31/00* (2006.01)
*E21B 34/06* (2006.01)

(52) U.S. Cl.
CPC ..... *E21B 31/005* (2013.01); *E21B 34/066* (2013.01)

(58) Field of Classification Search
CPC ..... E21B 34/066; E21B 31/005
See application file for complete search history.

(56) References Cited

U.S. PATENT DOCUMENTS

| | | | |
|---|---|---|---|
| 5,679,894 | A | 10/1997 | Kruger et al. |
| 6,142,245 | A | 11/2000 | Best |
| 6,431,291 | B1 | 8/2002 | Moore et al. |
| 6,910,542 | B1 | 6/2005 | Walter |
| 7,165,612 | B2 | 1/2007 | McLaughlin |
| 7,180,826 | B2 | 2/2007 | Kusko et al. |
| 7,533,724 | B2 | 5/2009 | McLaughlin |
| 7,748,476 | B2 | 7/2010 | Krueger, V |
| 7,770,667 | B2 | 8/2010 | Moore |
| 7,836,948 | B2 | 11/2010 | Kusko et al. |
| 7,938,202 | B2 | 5/2011 | Mitchell |
| 7,954,562 | B2 | 6/2011 | Mock |
| 7,954,563 | B2 | 6/2011 | Mock et al. |
| 7,958,952 | B2 | 6/2011 | Kusko et al. |
| 8,028,766 | B2 | 10/2011 | Moore |

(Continued)

FOREIGN PATENT DOCUMENTS

WO 2006071591 7/2006

OTHER PUBLICATIONS

IADC Drilling Manual, 2014.

(Continued)

*Primary Examiner* — Tara Schimpf
*Assistant Examiner* — Lamia Quaim
(74) *Attorney, Agent, or Firm* — McAfee & Taft

(57) ABSTRACT

A downhole tool configured for inclusion in a drill string, typically as part of a bottom hole assembly. The downhole tool configured to improve passage of the drill string through a borehole. Additionally, the downhole tool is suitable for use in a method for improving passage of a drill string through a borehole.

18 Claims, 7 Drawing Sheets

(56) References Cited

U.S. PATENT DOCUMENTS

| | | | |
|---|---|---|---|
| 8,061,447 | B2 | 11/2011 | Krueger, V |
| 8,069,917 | B2 | 12/2011 | Bloom et al. |
| 8,119,047 | B2 | 2/2012 | Moore et al. |
| 8,138,943 | B2 | 3/2012 | Kusko et al. |
| 8,146,680 | B2 | 4/2012 | Mock et al. |
| 8,245,796 | B2 | 8/2012 | Mock et al. |
| 8,302,679 | B2 | 11/2012 | Mock |
| 8,439,129 | B2 | 5/2013 | Mock et al. |
| 8,485,278 | B2 | 7/2013 | Mock |
| 8,511,377 | B2 | 8/2013 | Casassa et al. |
| 8,555,963 | B2 | 10/2013 | Bloom et al. |
| 8,668,007 | B2 | 3/2014 | Casassa et al. |
| 8,720,572 | B2 | 5/2014 | Lerner et al. |
| 9,013,957 | B2 | 4/2015 | Vecseri et al. |
| 9,133,664 | B2 | 9/2015 | MacDonald et al. |
| 9,309,762 | B2 | 4/2016 | MacDonald et al. |
| 9,322,217 | B1 | 4/2016 | Williams et al. |
| 9,366,100 | B1 | 6/2016 | Baudoin |
| 9,540,895 | B2 | 1/2017 | Mackenzie et al. |
| 9,637,976 | B2 | 5/2017 | Lorenson et al. |
| 9,702,204 | B2 | 7/2017 | MacDonald et al. |
| 9,708,891 | B2 | 7/2017 | Mitchell et al. |
| 9,765,584 | B2 | 9/2017 | Lorenson et al. |
| 9,822,635 | B2 | 11/2017 | MacDonald et al. |
| 9,879,495 | B2 | 1/2018 | Baudoin |
| 9,951,582 | B2 | 4/2018 | Baudoin |
| 9,988,859 | B2 | 6/2018 | Baudoin |
| 10,001,573 | B2 | 6/2018 | Kusko et al. |
| 10,208,543 | B2 | 2/2019 | Baudoin |
| 10,408,007 | B2 | 9/2019 | von Gynz-Rekowski et al. |
| 10,465,510 | B2 | 11/2019 | Baudoin |
| 10,502,014 | B2 | 12/2019 | Kletzel |
| 10,519,717 | B2 | 12/2019 | Pregeant et al. |
| 10,619,437 | B2 | 4/2020 | Lorenson et al. |
| 10,633,920 | B2 | 4/2020 | Lorenson et al. |
| 10,633,968 | B2 | 4/2020 | MacDonald et al. |
| 10,648,265 | B2 | 5/2020 | Kinsella et al. |
| 10,662,767 | B2 | 5/2020 | MacDonald et al. |
| 10,801,264 | B2 | 10/2020 | Lorenson et al. |
| 10,907,421 | B2 | 2/2021 | Creighton et al. |
| 10,927,601 | B2 | 2/2021 | Lorenson et al. |
| 10,968,721 | B2 | 4/2021 | Lorenson et al. |
| 11,105,154 | B1 | 8/2021 | Wesson |
| 11,215,013 | B2 | 1/2022 | McLaughlin |
| 11,268,337 | B2 | 3/2022 | Kinsella et al. |
| 11,441,376 | B2 | 9/2022 | McLaughlin |
| 11,542,806 | B2 | 1/2023 | Fellinghaug et al. |
| 11,788,382 | B2 | 10/2023 | Lorenson et al. |
| 12,018,558 | B2 | 6/2024 | Fellinghaug et al. |
| 2010/0314131 | A1 | 12/2010 | Krueger, V |
| 2011/0042100 | A1 | 2/2011 | O'Neal et al. |
| 2011/0083845 | A1 | 4/2011 | McLaughlin |
| 2012/0103619 | A1* | 5/2012 | Schroeder ..... E21B 21/10 29/890.124 |
| 2012/0195542 | A1 | 8/2012 | Marchand |
| 2013/0113227 | A1 | 5/2013 | Mitchell |
| 2013/0199846 | A1 | 8/2013 | Krueger, V et al. |
| 2014/0144705 | A1 | 5/2014 | Baudoin |
| 2014/0166369 | A1 | 6/2014 | Bloom et al. |
| 2014/0190749 | A1 | 7/2014 | Lorenson et al. |
| 2015/0211312 | A1 | 7/2015 | Krueger, V |
| 2015/0354307 | A1 | 12/2015 | Baudoin |
| 2016/0002985 | A1 | 1/2016 | Baudoin |
| 2016/0017690 | A1 | 1/2016 | Baudoin |
| 2016/0273276 | A1 | 9/2016 | Baudoin |
| 2018/0163495 | A1 | 6/2018 | Kinsella et al. |
| 2018/0283123 | A1 | 10/2018 | Baudoin |
| 2022/0145714 | A1 | 5/2022 | Kinsella et al. |
| 2023/0417126 | A1 | 12/2023 | Lorenson et al. |
| 2024/0035348 | A1 | 2/2024 | Kinsella et al. |

OTHER PUBLICATIONS

Drilling Knowledge Steerable Downhole Mud Motor—Directional Drilling, drillingknowledge.blogspotcom/2017/11/steerable-downhole-mud-motor.html, pp. 1-6, Jul. 27, 2023.

* cited by examiner

EXTENDED REACH AND JARRING TOOL FOR A BOTTOM HOLE ASSEMBLY

CROSS REFERENCE TO RELATED APPLICATIONS

The present application claims priority to U.S. Provisional Application No. 63/413,775 filed on Oct. 6, 2022, and U.S. Provisional Application No. 63/526,881 filed on Jul. 14, 2023, which are incorporated herein.

BACKGROUND

In the drilling and completion industry, wellbores are drilled to significant depths for the purpose of production and/or injection of fluids, including hydrocarbons. Oftentimes frictional forces between the tubing being lowered into the well and the casing or formation wall are such that it is difficult to reach the required depth. In some cases, the tubing may actually lock up, such that the snubbing force applied from the surface is unable to overcome the frictional forces. Extended reach tools are utilized to assist in overcoming the frictional forces.

BRIEF DESCRIPTION OF THE DRAWINGS

FIG. 6 schematically depicts a drill string lowered into a wellbore with a downhole tool incorporated therein.

DETAILED DESCRIPTION

Figure 1:
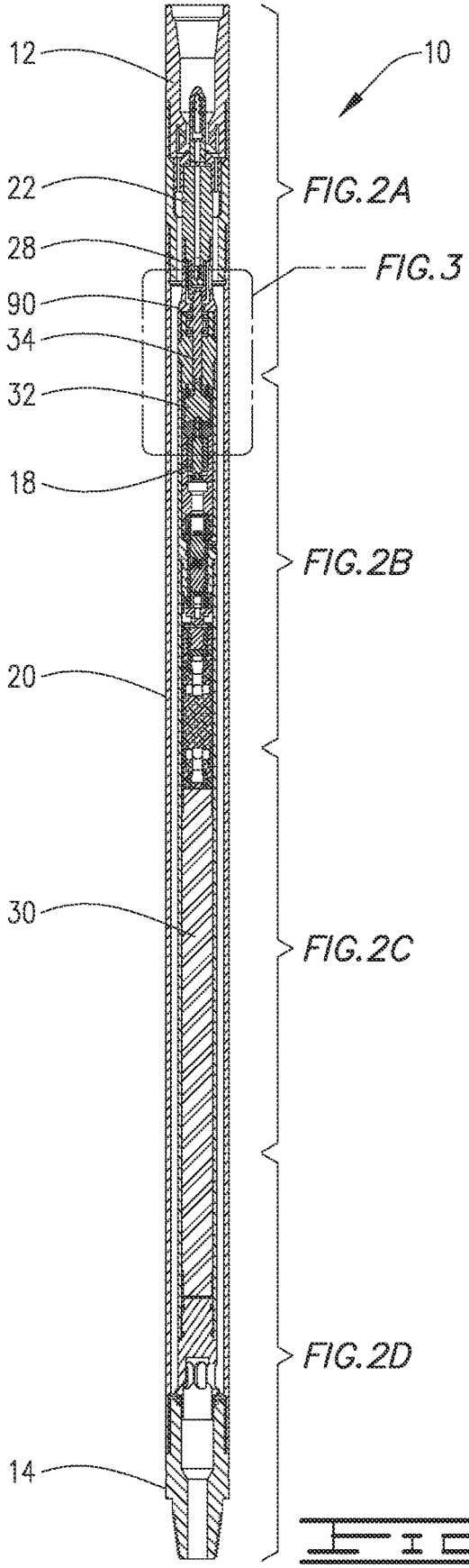
FIG. 1 depicts a sectional view of a downhole tool suitable for incorporation into a drill string.

The drawings included with this application illustrate certain aspects of the embodiments described herein. However, the drawings should not be viewed as exclusive embodiments. The subject matter disclosed is capable of considerable modifications, alterations, combinations, and equivalents in form and function, as will occur to those skilled in the art with the benefit of this disclosure.

The present disclosure may be understood more readily by reference to these detailed descriptions. For simplicity and clarity of illustration, where appropriate, reference numerals may be repeated among the different figures to indicate corresponding or analogous elements. The following description is not to be considered as limiting the scope of the embodiments described herein. The drawings are not necessarily to scale and the proportions of certain parts may have been exaggerated to better illustrate details and features of the present disclosure. Also, the phraseology and terminology employed herein is for the purpose of description and should not be regarded as limiting except where indicated as such.

Throughout this disclosure, the terms "about," "approximate," and variations thereof are used to indicate that a value includes the inherent variation or error for the device, system, or measuring method being employed as recognized by those skilled in the art.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally toward the surface; likewise, use of "down," "lower," "downward," "downhole," "downstream," or other like terms shall be construed as generally away from the surface, regardless of the wellbore orientation. Use of any one or more of the foregoing terms shall not be construed as denoting positions along a perfectly vertical axis. A wellbore can include vertical, inclined or horizontal portions, and can be straight or curved.

The disclosed downhole tool 10 provides improved movement of drill strings through a borehole. Downhole tool 10 as shown in the FIGS. is suitable for use in drill strings in the form of coiled tubing or drill strings of solid tubulars. Both types of drill strings are commonly used in hydrocarbon production. When used with coiled tubing, downhole tool 10 is configured for incorporation into the bottom hole assembly (BHA) 5 commonly used in such drill strings. When used with tubulars, the downhole tool 10 is configured for incorporation at one or more of the joints between the tubulars. Tool 10 is shown lowered on a drill string 2, which in one embodiment may be a coiled tubing into a wellbore 4. Wellbore 4 may have a casing 6 therein but also may be an open hole wellbore. The downhole tool 10 may be used in vertical or deviated wells which like wellbore 4 have a vertical section 7 and a deviated section 8. Although in the disclosed embodiment downhole tool 10 is depicted as lowered on a coiled tubing with a drill bit at an end thereof, it is understood that the downhole tool 10 may be conveyed into the well on jointed pipe as well, and may be any pipe or tubing such as a completion string, logging string, drill string or other type of string or piping employed in a downhole operation.

Downhole tool 10 can be activated in one of two active modes. In the first mode, the downhole tool imparts an oscillation frequency to the drill string thereby reducing friction between the drill string and the borehole walls. In the second mode, the downhole tool imparts a jarring effect to the drill string suitable for releasing the drill string or a downhole tool that has become stuck within the borehole. In addition to enhancing the movement of a drill string through a borehole, the configuration of downhole tool 10 permits unmodulated or unimpeded flow of fluid through downhole tool 10 when not in an active mode. The method of operating downhole tool 10 will be described in more detail below.

The optional configurations of downhole tool 10 will be described with reference to the FIG. 1*n* one embodiment, downhole tool 10 includes a proximal or first end 12 and a distal or second end 14 positioned at opposing ends of a tool housing 20. First and second ends 12 and 14 may be configured either for attachment within a BHA 5 or as part of a joint between tubulars making up a traditional drill string.

A fluid passageway 16 extends from first end 12 to second end 14 and provides a path for drilling mud or other fluid to pass through downhole tool 10. Also located within tool housing 20 is an electric motor 18, a flow control valve 22, a flow detection module 24, a motor control module 26 and a pilot valve 28. In one embodiment pilot valve 28 is a generally cup-shaped cylindrical valve with one or more ports 86 in an outer wall 29 thereof. Flow control valve 22 and tool housing 20 define an annulus 21 therebetween. Annulus 21 forms a portion of fluid passageway 16. An inner surface of tool housing 20 defines a fluid flow control seat 23. Motor 18 and a gearbox 32 are positioned within a motor housing 38. Electric motor 18 receives current from batteries 30. Batteries 30 may take any convenient form provided that the stored electrical energy is sufficient for the intended operational duration of downhole tool 10. Typically, a set of D cell batteries sufficient to supply 28 volts will suffice.

Figure 3:
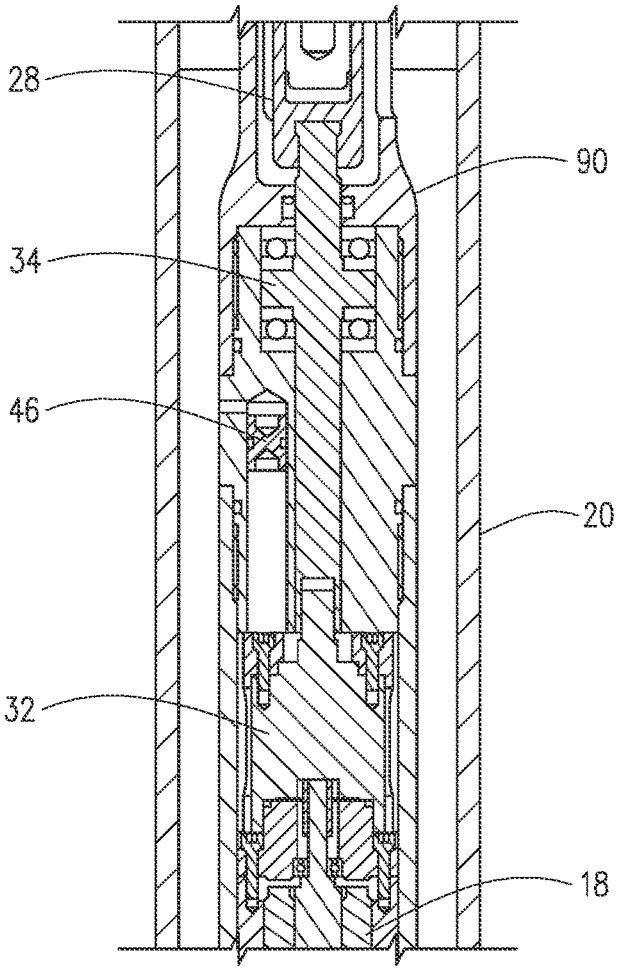
FIG. 3 is a sectional view corresponding to area 3 identified in FIGS. 2A and 2B.

A drive shaft 34 connects gearbox 32 to pilot valve 28. Flow detection module 24, motor control module 26, an accelerometer 36 and batteries 30 are all positioned within an electronics housing 39. With reference to FIGS. 2A-2D and 4A and 4B, fluid passageway 16 begins at first end 12 and passes through fluid flow control valve 22, pilot valve 28 and an annulus 40 defined by the interior wall of housing 20, the motor/gearbox housing 38 and the electronics housing 39. Fluid passageway 16 exits through the distal end 14 of downhole tool 10. In most embodiments, drive shaft 34 will be supported by bearings 42 within a drive shaft housing 44. Motor housing 38 is connected at its first, or upper end to drive shaft housing 44 and at its second end to electronics housing 39. An optional pressure compensation piston 46 may be positioned in drive shaft housing 44 as shown in FIG. 3. An electronics chassis 48 is positioned in electronics housing 39.

Figure 5A:
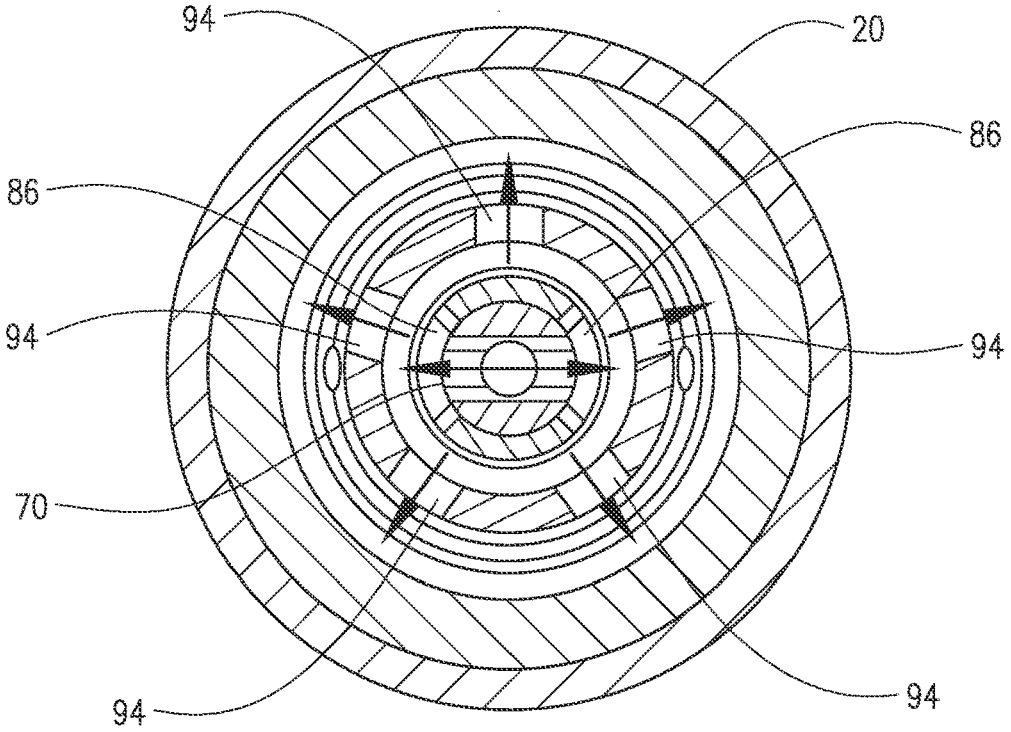
FIGS. 5A and 5B correspond to section lines A-A and B-B of FIGS. 4A and 4B respectively.

Fluid flow control valve 22 in one embodiment comprises a poppet valve with poppet mandrel 50 and a poppet 52 that is slidable relative to poppet mandrel 50. Poppet mandrel 50 has outer surface 51, an upper end 54 and a lower end 56. Poppet mandrel 50 comprises a mandrel body 58 and a reduced diameter mandrel neck 60 defining an upward facing shoulder 61. A longitudinal central flow passage 64 is defined through flow control valve 22. A plurality of radially directed ports 66 are defined through a wall of poppet mandrel 50, and specifically through mandrel neck 60. An external upward facing shoulder 68 is defined on outer surface 51 of poppet mandrel 50, and in the embodiment described on mandrel body 58. Radial ports 70 (shown more clearly in FIGS. 5A and 5B) are defined in mandrel body 58 at the lower end thereof.

Poppet 52 comprises a poppet head 72 with a generally cylindrical wall 74 extending therefrom. Poppet 52 has downward facing shoulder 62 and defines a cavity 76 in which poppet mandrel 50 is received. Poppet 52 has first, or upper end 78 and second, or lower end 80. As described in more detail below, when pilot valve 28 is in an open position, fluid in tool housing 20 is permitted to flow through longitudinal central flow passage 64 and radial exit ports 70 in fluid flow control valve 22 into fluid passageway 16. Poppet 52 is slidable relative to poppet mandrel 50.

Pilot valve 28 has first, or upper end 82 and second or lower end 84. Second end 84 has internal threads to connect to drive shaft 34. Pilot valve ports 86 are defined through pilot valve 28, and in one embodiment in wall 29 of pilot valve 28. Pilot valve 28 may be a rotating cylindrical valve that is rotated by motor 18. Pilot valve 28 controls operation of fluid flow control valve 22. However, pilot valve 28 does not have a direct mechanical linkage to fluid flow control valve 22. Rather, pilot valve 28 controls the fluid flow through downhole tool 10 and fluid flow control valve 22 thereby managing the operation of fluid flow control valve 22.

Figure 2A:
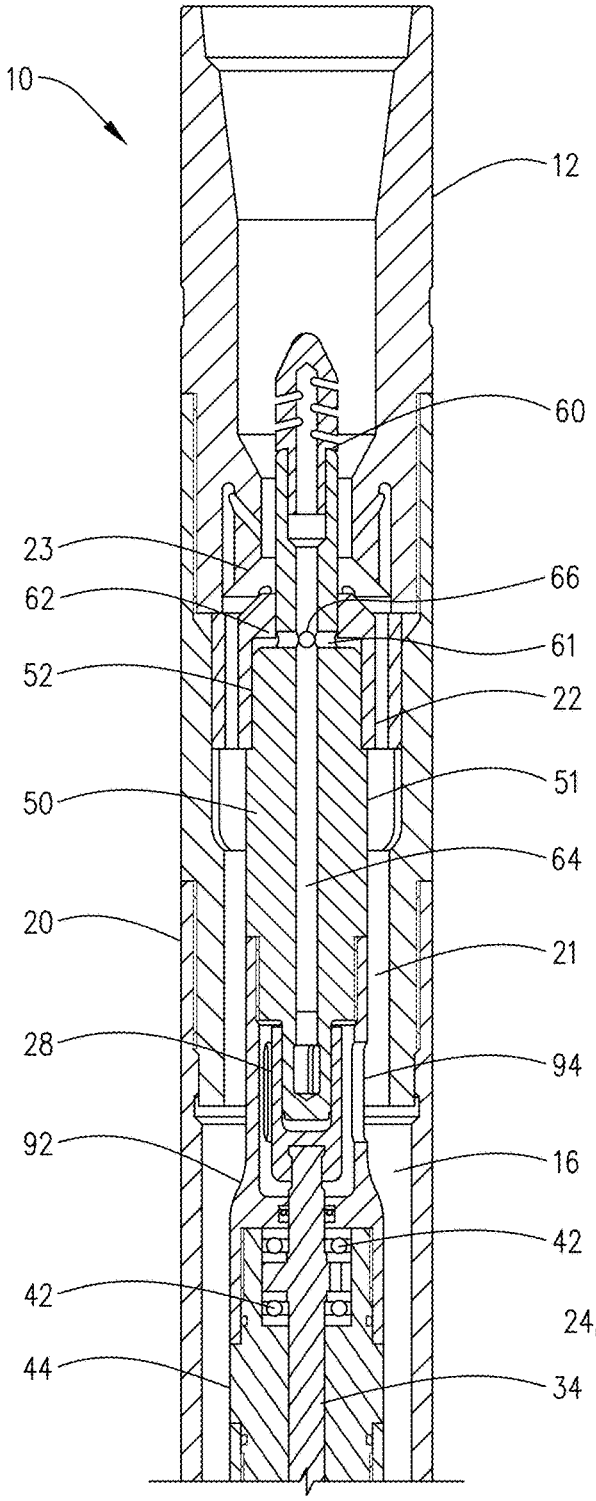
FIGS. 2A-2D are sectional views corresponding to the areas identified in FIG. 1.
Figure 2B:
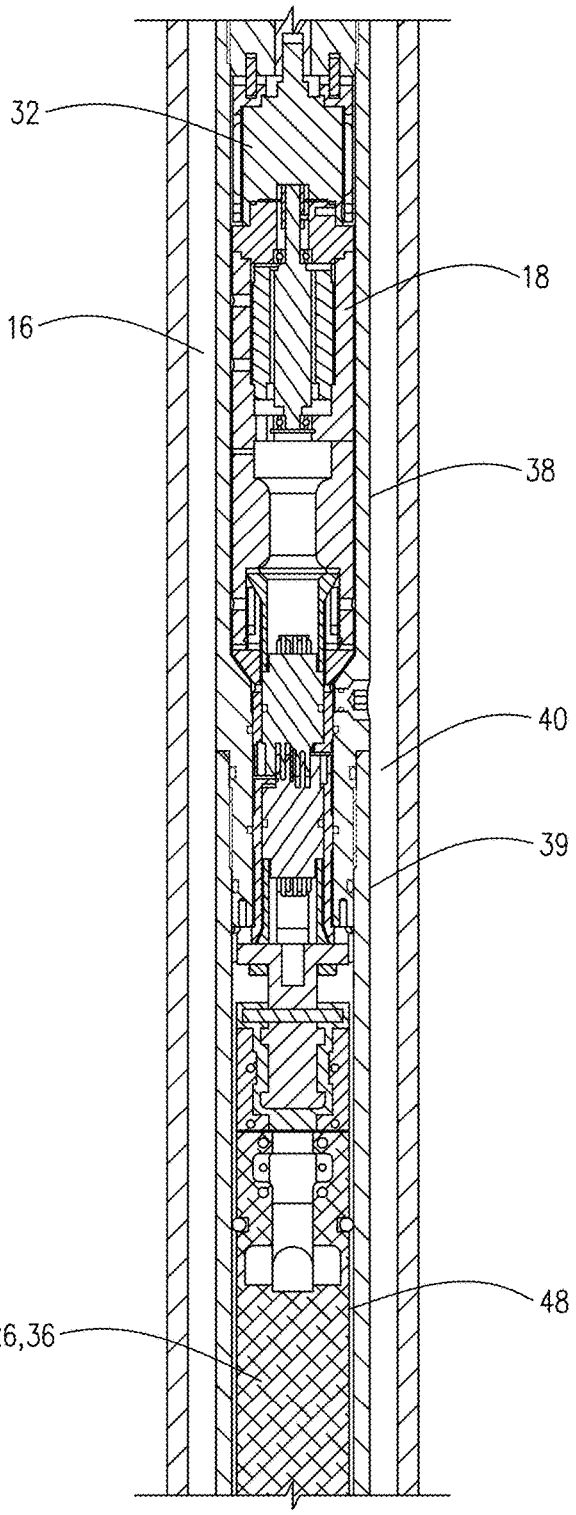
Figure 2C:
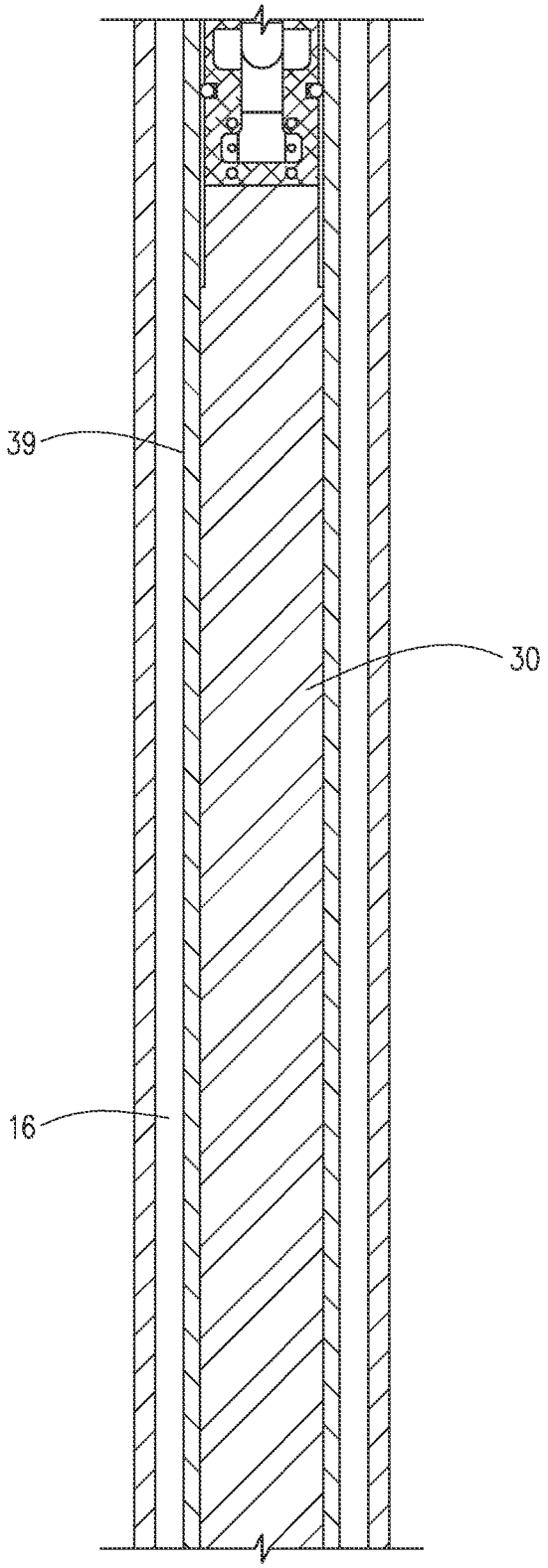
Figure 2D:
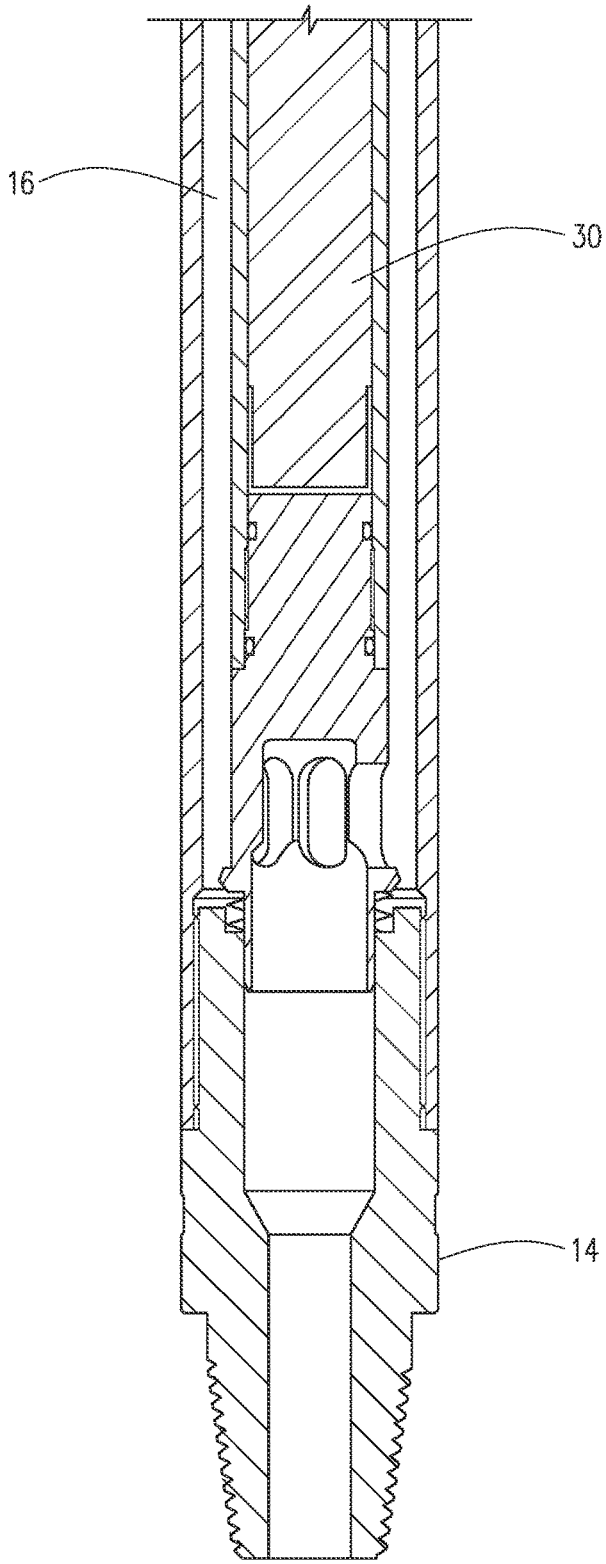
Figure 4A:
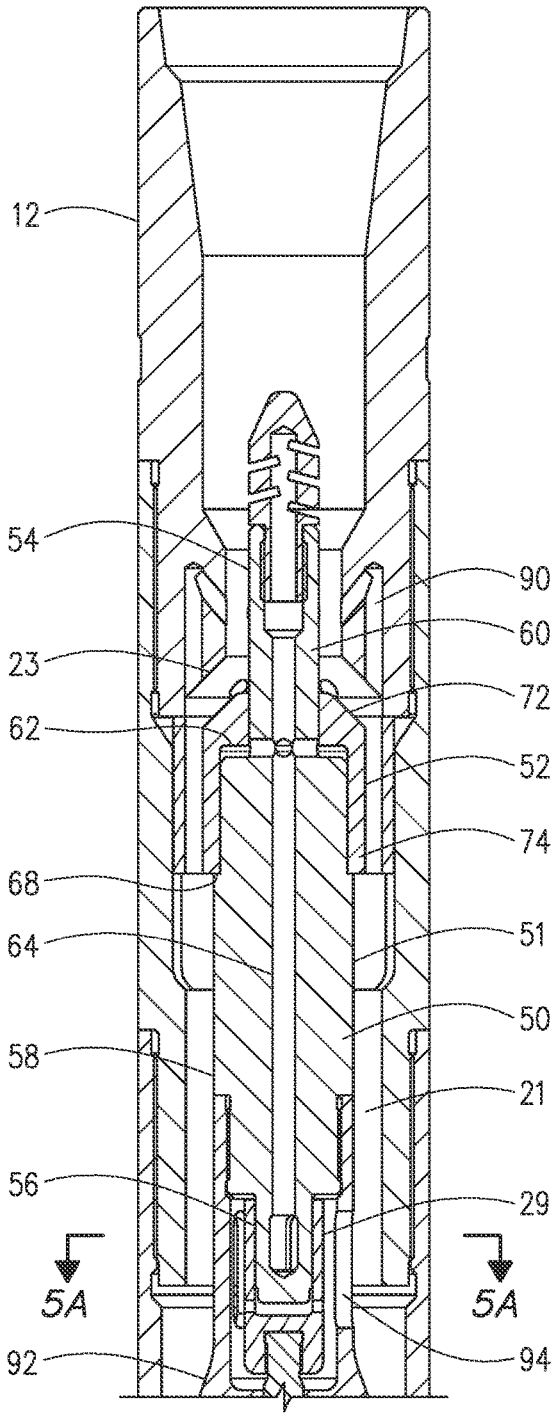
FIGS. 4A-4D depict the fluid control valve of the downhole tool in the closed and open positions.
Figure 4B:
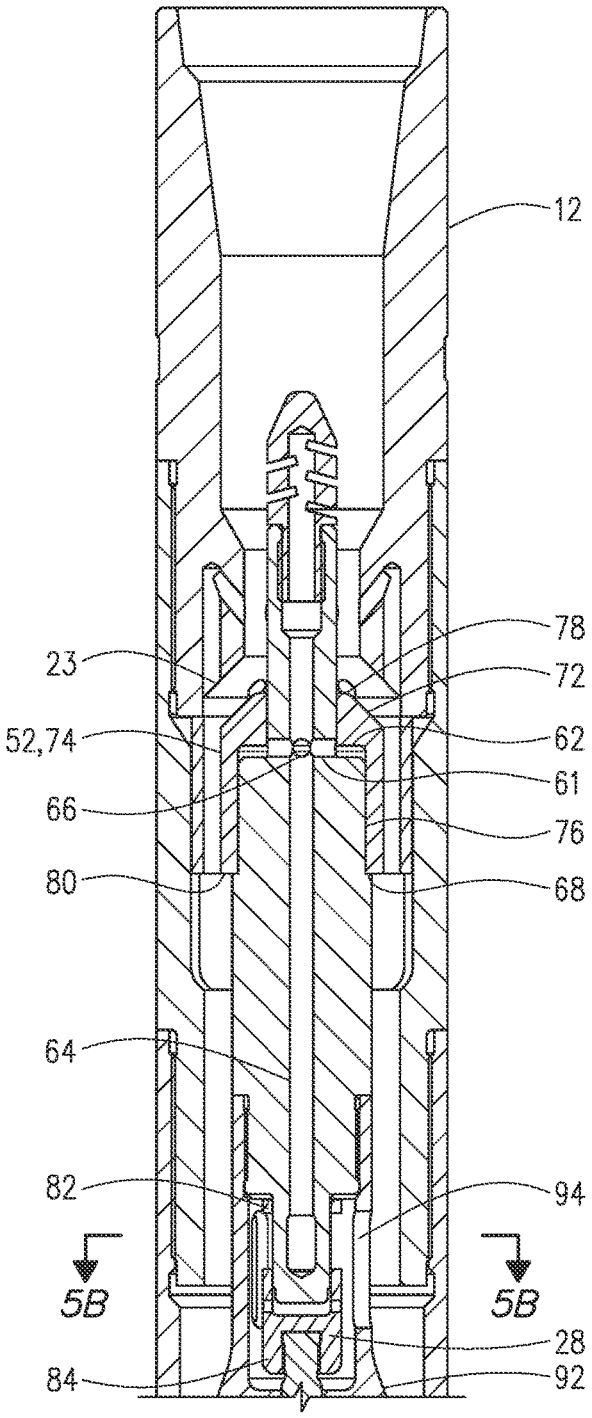

Fluid flow control valve 22 is located between pilot control valve 28 and first end (proximal end) 12 of downhole tool 10. In the described embodiment fluid flow control valve 22 may be a poppet valve which lacks a return spring. As such movement of fluid flow control valve 22 in the form of a poppet valve without a spring is controlled solely by fluid pressure as regulated by pilot valve 28. With reference to FIGS. 2A, 4A and 4B, fluid passageway 16 begins at first end 12 and passes through annulus 21 and annulus 40 defined by the inner surface of a wall of tool housing 20, the motor/gearbox housing 38 and the electronics housing 39 exiting through the distal end 14 of downhole tool 10. As explained below, when pilot valve 28 is in an open position, fluid in tool housing 20 will flow through flow control valve 22 and pilot valve 28 into annulus 40. More specifically, fluid will flow through longitudinal central flow passage 64 and radial exit ports 70 in flow control valve 22 and through pilot valve ports 86. Tool housing 20 also has bypass passages 90 defined therein that allow fluid in tool housing 20 to flow into annulus 21 when fluid flow control valve 22 is in a closed position. A slotted mandrel 92 is threadedly connected to the lower end of poppet mandrel 50 at a first end thereof and to drive shaft housing 44 at a second end thereof. Slots 94 in slotted mandrel 92 allow fluid flow from fluid flow control valve 22 to pass therethrough into annulus 40 when pilot valve 28 is in the open position.

Figure 4C:
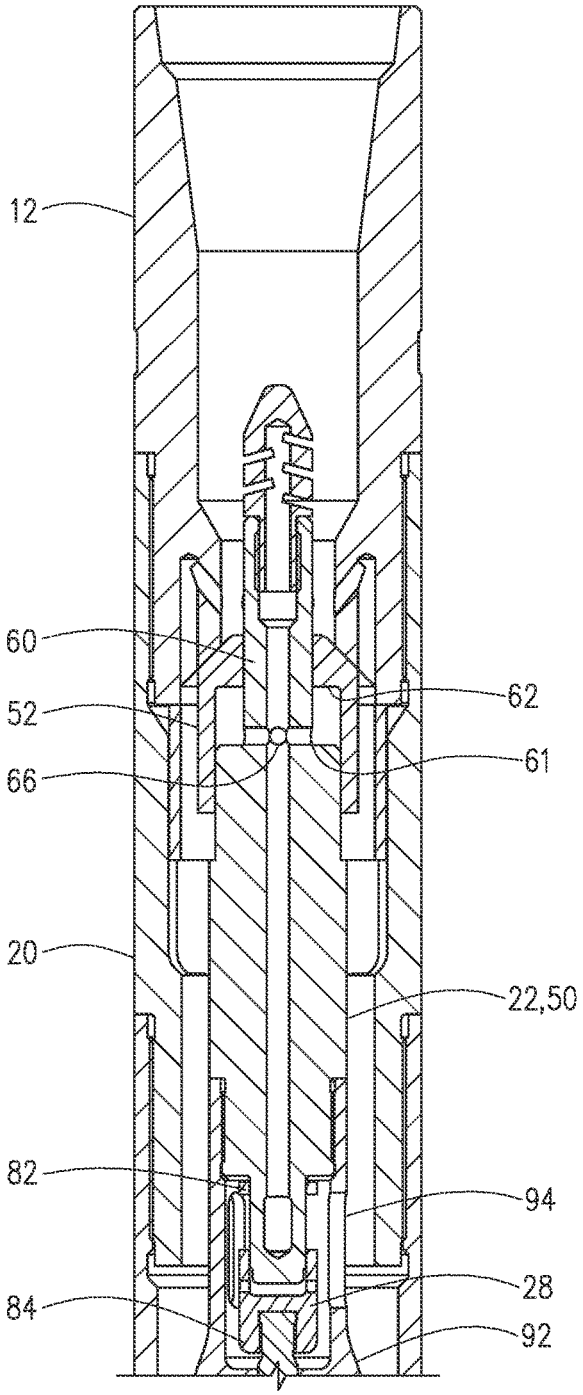
Figure 4D:
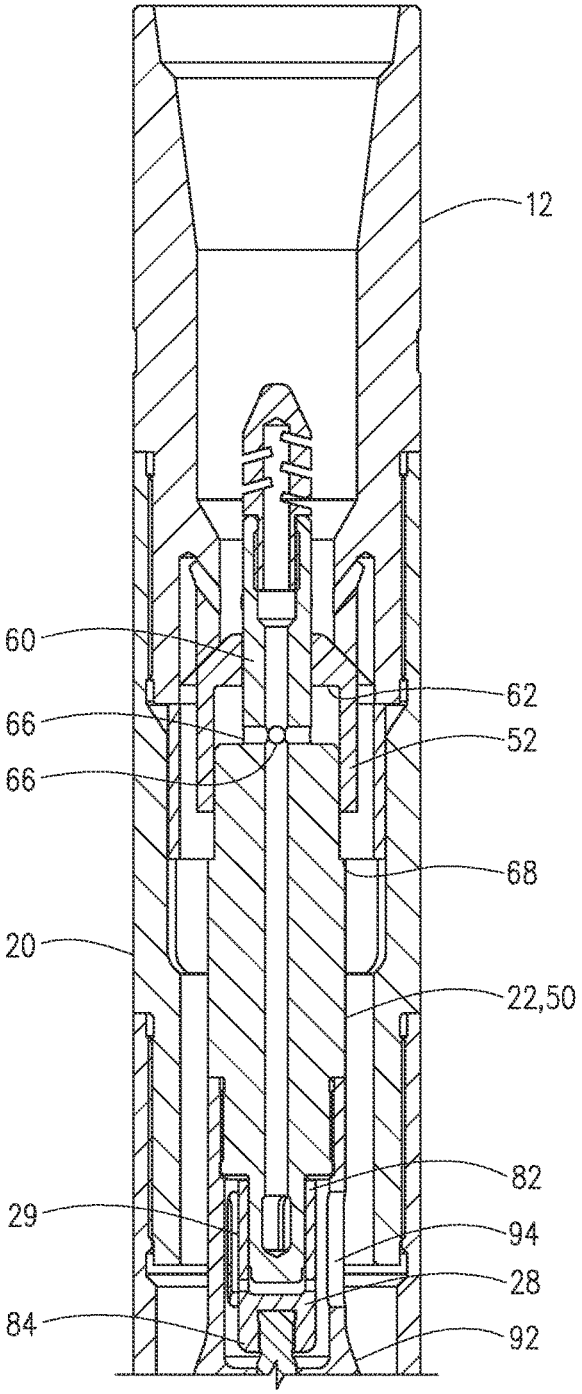
Figure 5B:
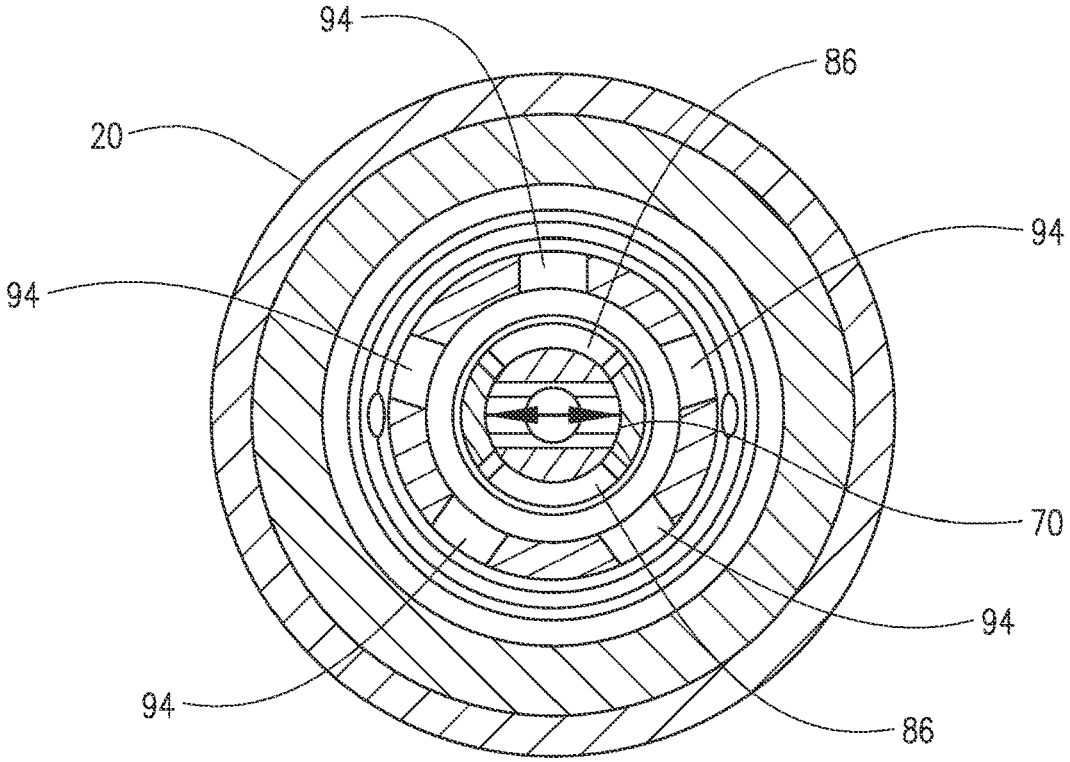
Figure 5:
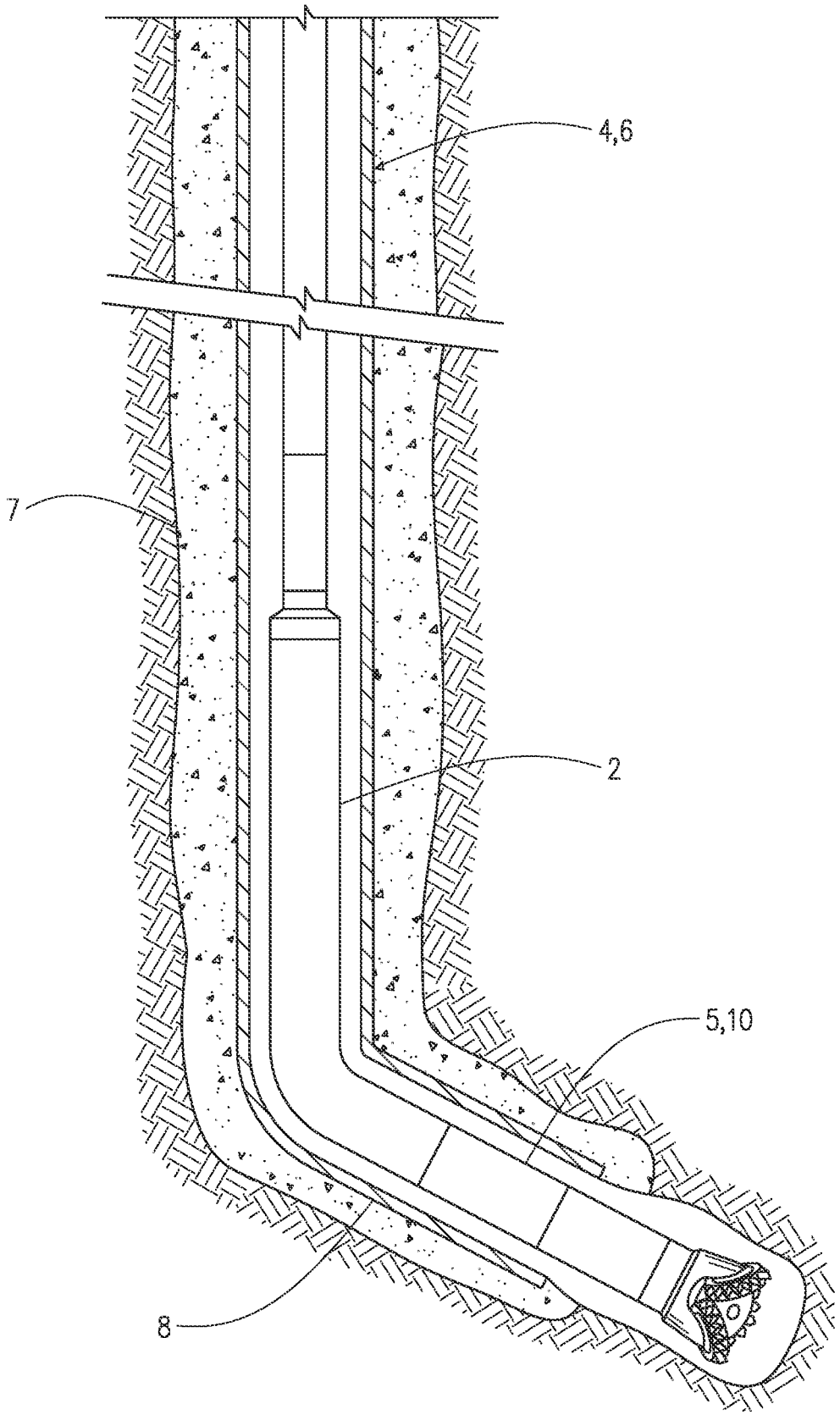

With reference to FIGS. 4B, 4C, and 5B with pilot valve 28 in the closed position flow through the lower end of poppet mandrel 50 is blocked. As a result, fluid flow through radial exit ports 70 is blocked, and fluid begins to flow into radial ports 66. The fluid is trapped, however, so the pressure on the bottom, i.e., downstream or distal end, of poppet 52 of fluid flow control valve 22 is greater than pressure on the top side, i.e., upstream or proximal end, of fluid flow control valve 22. The imbalanced fluid pressure drives poppet 52 of fluid control valve 22 upwards until it seals against fluid flow control valve seat 23. Thus, with pilot valve 28 in the closed position, fluid flow control valve 22 is moved into and held in the closed position. However, as reflected in FIG. 4C, fluid bypass passages 90 in tool housing 20 provide for continued flow into annulus 40 and through downhole tool 10. When pilot valve 28 is open flow through radial exit ports 70 is permitted and the pressure on the bottom of poppet 52 of fluid flow control valve 22 is less than pressure on the top side of fluid flow control valve 22. The resulting imbalance of fluid pressure drives the poppet 52 downwardly towards the distal end of downhole tool 10, i.e., the open position. Fluid flow control valve 22 is configured to move between an open position as depicted in FIG. 4A and a closed position as depicted in FIG. 4B. When held in the open position, as depicted in FIG. 4A, fluid flow control valve 22 permits unmodulated, i.e., unimpeded fluid flow through downhole tool 10. FIGS. 4A-4D are representative of the sequence of operations that occur when the fluid flow control valve 22, and thus the tool 10 cycle between open and closed positions. When the pilot valve is open, as shown in FIG. 4A, fluid flow control valve 22 is likewise open. To move the fluid flow control valve 22 to the closed position, pilot valve 28 is moved to the closed position as shown in FIG. 4B. FIG. 4B shows the fluid flow control valve 22 still in the open position. As soon as pilot valve 28 moves to the closed position fluid flow control valve 22 will move to its closed position as shown in FIG. 4C. FIG. 4D shows the pilot valve 28 rotated to the open position. When this occurs, fluid flow control valve 22 will move back to the open position shown in FIG. 4A.

As will be described below in relation to the operation of downhole tool 10, pilot valve 28 transitions between the open and closed positions during operation of downhole tool 10. Thus, until fluid pressures on the top and bottom of poppet 52 of fluid flow control valve 22 react to the change in pilot valve 28 movement, fluid flow control valve 22 does not reflect the change in pilot valve 28 positioning. The closed position of the pilot valve is the position in which no flow therethrough is permitted.

Control of motor 18, gearbox 32 and pilot valve 28 is provided by electronics chassis 48 located within electronics housing 39. As noted above, electronics chassis 48 includes flow detection module 24, motor control module 26, accelerometer 36 and batteries 30. Flow detection module 24 includes programming suitable for monitoring accelerometer 36 and detecting changes in fluid flow characteristics of a fluid passing through downhole tool 10. In most instances, flow detection module 24 includes programming for monitoring accelerometer 36 and detecting vibrations produced by a fluid flowing through downhole tool 10. Altering the fluid velocity will alter the vibrations generated by the fluid and hence the vibrations sensed by the accelerometer 36. Further, flow detection module 24 includes programming which interprets the detected changes in the passing fluid such as a distinct series of vibrations and in response to the detected series of vibrations transmits any one of a plurality of operating mode signals to motor control module 26.

Motor control module 26 includes programming suitable for receiving the operating mode signal and implementing an operating mode corresponding to the received operating mode signal. Implementation of the operating mode includes managing the operation of motor 18 which in turn controls operation of pilot valve 28 via gearbox 32 and drive shaft 34. As discussed above, pilot valve 28 manages operation of fluid flow control valve 22.

The foregoing discussion describes one embodiment of downhole tool 10. However, modifications may be made to downhole tool 10 as described herein without negatively impacting the ability of downhole tool 10 to unmodulated fluid flow when fluid flow control valve 22 is in the open or inactive position. For example, downhole tool 10 may replace pilot valve 28 with a linear actuator which in turn drives fluid flow control valve 22. A typical linear actuator is a solenoid. When using a solenoid in place of pilot valve 28, fluid flow control valve 22 will typically be a linear motion poppet valve.

With continued reference to the FIGS., the operation of downhole tool 10 will be described. When running a coiled tubing drill string into a borehole, the operator may elect to use a friction reducing tool commonly known as an extended reach tool. Currently available extended reach tools are mechanically operated. These tools lack the option of an inactive mode. Thus, current extended reach tools operate during the entire drill string insertion and frequently damage the drill string and/or bottom hole assembly 5. In contrast, downhole tool 10 provides for an inactive mode which permits unmodulated fluid flow through downhole tool 10. As a result, downhole tool 10 is activated only when a need exists to reduce insertion drag or to free a drill string or tool that has become hung up.

Thus, use of downhole tool 10 provides an improved method for running drill string into a borehole. When the drill string is coiled tubing, downhole tool 10 will be included in BHA 5. As known to those skilled in the art, BHA 5 is located at the distal end of the drill string. Downhole tool 10 may be located anywhere within BHA 5. When the drill string is made up of conventional tubular pipe, downhole tool 10 may be located at one or more joints between adjacent tubulars. Downhole tool 10 may be used in connection with any number of downhole processes, including, in non-limiting examples, drilling operations for drilling out frac plugs or other drilling operations. In such a case a drill bit will be connected in the coiled tubing or other string below the downhole tool 10. Although downhole tool 10 may be used in drilling operations, downhole tool 10 may be used in connection with other operations, including, in non-limiting examples, fishing and cleanout operations.

During the insertion process, one or more pumps located either at the surface or in the drill string at locations above BHA 5 force working fluid through the drill string. In the initial insertion, the working fluid will be pumped through passageway 16 in downhole tool 10, and tool 10 will be in an inactive mode. If the tubing on which downhole tool 10 can be moved through the wellbore in which it is inserted without the need for activating downhole tool 10, flow will continue unimpeded until the tubing reaches the desired location in the well. If during insertion it is desired to impart oscillations to the tubing, or to generate a jarring impact to the tubing, the pumps delivering the fluid can be operated to achieve both.

Operation of the pumps will impart vibrations within the fluid flowing through the drill string. Thus, controlled operation of the pumps can impart a series of detectible vibrations in the flowing fluid. The well operator can select a series of vibrations which correspond to an operating mode stored within the memory components of flow detection module 24 and motor control module 26. By managing operation of the pumps, the selected vibration signal is transmitted downhole to downhole tool 10. Using onboard programming, flow detection module 24 senses the series of vibrations. In most embodiments, flow detection module 24 includes an accelerometer 36 suitable for detecting fluid vibrations.

Flow detection module 24 includes programming suitable for reading the sensed vibrations and correlating the sensed vibrations to one of a plurality of operating modes and operating mode signals. When the flow detection module 24 identifies a series of vibrations which correspond to an operating mode stored in its memory, flow detection module 24 will select and send the corresponding operating mode signal to motor control module 26. Upon receipt of an operating mode signal, motor control module 26 will manage operation of electric motor 18 and gearbox 32 in accordance with the received operating mode signal. Alternatively, motor control module 26 will manage the operation of the linear actuator or other control mechanism managing operation of fluid flow control valve 22.

While a plurality of operating modes may be programmed into motor control module 26, at a minimum, the following operating modes will be provided: Default Mode=OFF; Mode 1=ON at Frequency 1; Mode 2=ON at Frequency 2; and, Mode 3=intermittent jarring action.

In the Default Mode, motor control module 26 turns off motor 18. In this mode, pilot valve 28 is inactive and resting in the open position. As a result, fluid flow control valve 22 is held open by fluid pressure exerted against the top or proximal end of poppet 52 of fluid flow control valve 22 which is greater than fluid pressure exerted against the bottom or distal end of poppet 52. Thus, in the Default Mode, fluid flowing through the drill string enters BHA 5 and passes through downhole tool 10 through fluid passageway 16 unimpeded by fluid flow control valve 22. Thus, the fluid flows through unmodulated and downhole tool 10 does not impart any vibrations or oscillations to the drill string. Thus, the Default Mode reduces stress on the drill string during insertion operations that do not require friction reduction.

When the drill string does not slide through the borehole at a desired rate, the operator may operate the pumps in a manner to send vibration signals to flow detection module 24 corresponding to one of a plurality of modes, e.g., Mode 1 or Mode 2. Note, while only two "On Modes" are described herein for exemplary purposes, additional On Modes operating at other frequencies could be programmed into flow detection module 24 and motor control module 26. When flow detection module 24 identifies a vibration pattern corresponding to one of the On Modes, flow detection module 24 selects the corresponding operating mode signal and transmits the signal to motor control module 26. Upon receipt of the operating mode signal, motor control module 26 activates motor 18. Operation of motor 18 through gearbox 32 drives pilot valve 28. As noted above, pilot valve 28 does not have a direct mechanical connection to fluid flow control valve 22. Rather, actuation of pilot valve 28 in response to operation of motor 18 manages the position of fluid flow control valve 22 through controlling the position of pilot valve 28. Shifting pilot valve 28 between the open and closed position causes corresponding opening and closing of fluid flow control valve 22.

In the open position of the fluid flow control valve 22 and pilot valve 28 fluid flows through longitudinal central flow passage 64 of fluid flow control valve 22, through radial ports 70, pilot valve ports 86 which are aligned with ports 70 and slots 94 in slotted mandrel 92 into annulus 40. To close fluid flow control valve 22, motor 18 rotates pilot valve 28 in response to a signal received from flow detection module 24. The rotation of pilot valve 28 creates a misalignment between radial exit ports 70 and pilot valve ports 86 and blocks flow therethrough. As a result, fluid is pushed radially outwardly into ports 66 in poppet mandrel 50. Ports 66 have no exit and fluid pressure is created that pushes upwardly on poppet 52, urging poppet 52 upwardly on poppet mandrel 50 into fluid flow valve seat 23 defined on tool housing 20. Continued rotation of pilot valve 28 will realign radial ports 70 and pilot valve ports 86 allowing flow therethrough and releasing the upward fluid pressure applied to poppet 52. Poppet 52 will slide downwardly on poppet mandrel 50 and move to the open position of fluid flow control valve 22.

In one optional embodiment, fluid flow control valve 22 cycles between fully closed, i.e., seated against fluid flow control valve seat 23, and fully open. However, in other embodiments, the stroke of fluid flow control valve 22 may be limited through actuation of pilot valve 28 to preclude seating. In this embodiment, the operator has the ability to control the amplitude of the resulting pressure pulses through selection of the appropriate Operating Mode.

The longer the fluid flow control valve 22 is held in the closed position, the greater fluid pressure develops behind or upstream of fluid flow control valve 22. During the pressure buildup, the drill string stiffens. Upon release of the increased fluid pressure through fluid flow control valve 22, the drill string in turn relaxes. Without intending to be limited by theory, it is believed that the cycling of stiffening and relaxing of the drill string improves movement of the drill string through the borehole. Thus, an operating signal corresponding to an On Mode will produce lower resistance to the insertion of the drill string into the borehole.

The On Mode may cycle fluid flow control valve 22 between the open and closed positions at a rate between about 1 to 8 cycles per second. More typically, the cycle rate of fluid flow control valve 22 will be between about 3 to 8 cycles per second with the most likely cycle rate being between 3 to 5 cycles per second. Lower cycle rates per second will increase the pressure associated with each cycle. Conversely, higher cycle rates per second will lower the pressure associated with each cycle as fluid flow control valve 22 spends a reduced period of time in the off position thereby limiting fluid pressure build up.

In one embodiment motor 18 rotates pilot valve 28 at a non-constant speed in response to signals received from the flow detection module 24. The non-constant rotation will provide for a snap open and snap closed operation and an increase in the dwell time of the flow control valve 22 in the open/closed positions, along with a reduction in transition time as a proportion of the overall cycle time. For example, during the initial insertion downhole tool 10 will be in a fully open position to allow unimpeded flow therethrough. When it is initially desired to impart a vibratory signal to downhole tool 10 to generate a desired oscillation pattern, the pilot valve 28 will begin rotation and will rotate to generate an almost immediate closure of radial exit ports 70 in fluid flow control valve 22 to prevent flow therethrough. Poppet 52 will snap upwardly to engage seat 23 and move fluid flow control valve 22 to the closed position. The speed of rotation of pilot valve 28 will then slow to increase the dwell time in the closed position of fluid flow control valve 22, which provides for a pressure buildup.

When pilot valve 28 rotates sufficiently such that pilot valve ports 86 nearly reach radial exit ports 70, the rotational speed will increase such that pilot ports 86 and radial exit ports 70 in fluid flow control valve 22 come into alignment in an almost immediate fashion, thereby moving the fluid flow control valve to the open position. The rotation of pilot valve 28 may then again momentarily slow, or stop to increase dwell time in the open position. When the desired amount of dwell time has occurred, the pilot valve 28 will once again rotate quickly to block flow through radial exit ports 70 and generate an almost immediate closure of fluid flow control valve 22. If desired, rather than slowing, or momentarily ceasing rotation in the open position of the fluid flow control valve, the rotation of pilot valve 28 may be such that ports 86 pass over radial exit ports 70 in fluid flow control valve 22 quickly to create an almost immediate snap from the closed to the open position and back to the closed positions of the fluid flow control valve 22. The dwell time in the open and/or closed positions can therefore be controlled by varying the speed of rotation of the pilot valve 28. Any number of variations in rotational speed may be used to create the desired oscillation of the downhole tool 10. Thus, the fluid flow control valve 22 can be opened and closed in predetermined timing sequences correlating to the operating mode signals produced by the flow detection module.

From time to time, drill strings become hung up on the irregularities of a borehole. To free the drill string, downhole tool 10 provides for imparting a jarring action to the drill string. As described above, a jarring action is another operating mode. When flow detection module 24 identifies a series of vibrations corresponding to the operating mode for a jarring action, the appropriate operating mode signal is sent to the motor control module 26. In this mode, motor control module 26 manages operation of motor 18 such that pilot valve 28 controls fluid flow control valve 22 at a much slower rate than any of the friction reduction modes. In a typical jarring mode, fluid control valve 22 will be controlled to cycle open and closed at rates between about 1 cycle per second to one cycle per thirty seconds. In some cases, cycle rates of about one per three seconds will provide the desired increase in fluid pressure necessary to impart a jarring action to the drill string. The dwell time in the closed position in this mode may be increased to a level such that when pilot valve 28 moves from the closed to the open position, the resulting movement of the poppet 52 of fluid flow control valve 22 is such that it creates the jarring impact.

The foregoing operational steps apply equally to the alternative embodiment configurations of downhole tool 10 discussed above. Additionally, the described operational steps are equally applicable to removal or retrieval of coiled tubing and tubular type drill strings from a borehole. Thus, operation of downhole tool 10 in accordance with the foregoing methods applies to both insertion and retrieval operations.

Other embodiments of the present invention will be apparent to one skilled in the art. As such, the foregoing description merely enables and describes the general uses and methods of the present invention. Accordingly, the following embodiments define the true scope of the present invention.

EMBODIMENTS INCLUDE

A downhole tool comprising a tool housing having first and second ends and configured for attachment within a drill string. A fluid passageway providing fluid communication through the downhole tool extends from the first end to the second end of the downhole tool. The downhole tool comprises a motor and a fluid flow control valve positioned within the fluid passageway, the fluid control valve movable between an open and a closed position in response to operation of the motor, the fluid flow control valve configured to permit unmodulated flow of a fluid through the fluid passageway when in the open position. A flow detection module is programmed to provide an operating mode signal in response to sensed fluid flow characteristics of the fluid passing through the fluid passageway. A motor control module in electronic communication with the flow detection module and the motor is programmed to receive the operating mode signal and programmed to manage operation of the motor to control movement of the flow control valve.

Embodiment 2. The downhole tool of embodiment 1, wherein the flow control valve is a poppet valve.

Embodiment 3. The downhole tool of embodiment 2, further comprising a pilot valve, the pilot valve positioned to control actuation of the poppet valve; a gearbox, the gearbox secured to the motor; and a drive shaft having a first end and a second end, the first end of the drive shaft secured to the gearbox and the second end of the drive shaft secured to the pilot valve.

Embodiment 4. The downhole tool of embodiment 3, wherein the pilot valve is a rotary valve.

Embodiment 5. The downhole tool of any of embodiments 1-4, wherein the flow detection module and motor control module are part of a single control circuit.

Embodiment 6. The downhole tool of any of embodiments 1-5, wherein the flow detection module includes an accelerometer and the flow detection module is programmed to use the accelerometer to produce the operating signal in response to the sensed fluid characteristics where the sensed fluid characteristics include vibrations in the fluid flowing through the friction reducing tool.

Embodiment 7. A method for reducing friction in a drill string as the drill string moves through a borehole, the method comprising running the drill string into a borehole. The drill string includes a friction reduction tool comprising a first end configured for attachment within the drill string; second end configured for attachment within the drill string; fluid passageway providing fluid communication through the friction reducing tool, the fluid passageway extending from the first end to the second end of the friction reducing tool; a motor; a fluid flow control valve positioned within the fluid passageway, the fluid control valve movable between an open and a closed position; a flow detection module programmed to provide a plurality of operating mode signals; and a motor control module in electronic communication with the flow detection module and the motor, the motor control module programmed to receive the operating mode signals. The method comprises flowing a fluid through the friction reduction tool; sensing vibrations generated by the fluid flowing through the friction reduction tool with the flow detection module; selecting one of the plurality of operating mode signals in response to the sensed vibrations; transmitting the selected operating mode signal to the motor control module; and operating the fluid control valve in accordance with the selected operating mode to control fluid flow through the friction reduction tool.

Embodiment 8. The method of embodiment 7, the flowing step comprising pumping fluid through the friction reduction tool in a predetermined flow pattern, wherein the vibrations created by the flow pattern correlate to one of the plurality of operating mode signals, the method further comprising selecting the operating mode signal to which the vibrations correlate.

Embodiment 9. The method of embodiment 8, wherein the step of operating the fluid control valve in accordance with the selected operating mode produces within the fluid flowing through the drill string one of: an oscillation frequency, an intermittent jarring action or a free flow of fluid; and wherein use of the operating modes which produce an oscillation frequency or an intermittent jarring action overcomes friction during movement of the drill string through the borehole.

Embodiment 10. The method of either of embodiments 8 or 9, wherein the selected operating mode operates the fluid flow control valve to cycle the fluid flow control valve between open and closed positions in a predetermined pattern.

Embodiment 11. The method of embodiment 10, wherein during each cycle between the open and closed position, the fluid flow control valve is in the closed position for a longer period of time than in the open position.

Embodiment 12. The method of either of embodiments 10 or 11 wherein during each cycle between the open and closed position, the fluid flow control valve is in the closed position for a shorter period of time than in the open position.

Embodiment 13. A downhole tool comprising a tool housing defining a fluid passageway therethrough extending from a first to a second end of the tool housing. A fluid flow control valve movable between open and closed positions is disposed in the tool housing, the flow control valve having a plurality of radial exit ports defined therein. A pilot valve is positioned in the tool housing and is rotatable relative to the fluid flow control valve. A motor is connected to the pilot valve and operable to rotate the pilot valve at a predetermined rate of rotation in response to an operating mode signal produced by a flow detection module in the tool housing, wherein rotation of the pilot valve opens and closes the radial exit ports at the predetermined rate to open and close the fluid flow control valve in a predetermined timing sequence.

Embodiment 14. The downhole tool of embodiment 13, wherein the operating mode signal is produced based on a vibration pattern created by fluid flowing in the tool housing.

Embodiment 15. The downhole tool of embodiment 14, comprising a flow detection module for producing the operating mode signal; a motor control module disposed in the tool housing; and a drive shaft connecting the motor control module to the pilot valve, wherein the operating mode signal is received by the motor control module and the motor control module rotates the pilot valve.

Embodiment 16. The downhole tool of embodiment 15, wherein the flow detection module is configured to produce a plurality of operating mode signals and wherein each operating mode signal corresponds to a different rate of rotation of the pilot valve.

Embodiment 17. The downhole tool of embodiment 16, wherein each of a plurality of operating mode signals is produced in response to a distinct vibration pattern created by fluid flowing in the tool housing.

Embodiment 18. The downhole tool of any of embodiments 13-17, the fluid flow control valve comprising a poppet valve, wherein in the closed position of the pilot valve the poppet valve is urged upwardly in the housing to engage and seat against the tool housing.

Embodiment 19. The downhole tool of embodiment 18, the poppet valve comprising: a poppet; and a poppet mandrel, the poppet being vertically reciprocable on the poppet mandrel.

Embodiment 20. The downhole tool of embodiment 19, wherein the operating mode signal causes the pilot valve to rotate at a non-constant rotational speed.

Other embodiments of the present invention will be apparent to one skilled in the art. As such, the foregoing description merely enables and describes the general uses and methods of the present invention. Accordingly, the following claims define the true scope of the present invention.

What is claimed is:

1. A downhole tool comprising:

a tool housing having first and second ends and configured for attachment within a drill string;

a fluid passageway providing fluid communication through the downhole tool, the fluid passageway extending from the first end to the second end of the downhole tool;

a motor;

a fluid flow control valve positioned within the fluid passageway, the fluid control valve movable between an open and a closed position, the fluid flow control valve configured to permit unmodulated flow of a fluid through the fluid passageway when in the open position;

a pilot valve disposed in the housing and movable between an open position in which fluid flow is permitted therethrough and a closed position in which no fluid flow is permitted therethrough;

a flow detection module programmed to provide an operating mode signal in response to sensed fluid flow characteristics of the fluid passing through the fluid passageway; and a motor control module in electronic communication with the flow detection module and the motor, the motor control module programmed to receive the operating mode signal and programmed to manage operation of the motor to control movement of the pilot valve between the open and closed positions based upon the operating mode signal, wherein the pilot valve is operable to move the flow control valve between the open and closed positions thereof.

2. The downhole tool of claim 1, wherein the fluid flow control valve is a poppet valve.

3. The downhole tool of claim 2, further comprising:

a gearbox, the gearbox secured to the motor; and a drive shaft having a first end and a second end, the first end of the drive shaft secured to the gearbox and the second end of the drive shaft secured to the pilot valve.

4. The downhole tool of claim 2, wherein the poppet valve reciprocates in the tool housing between the open and closed positions thereof solely as a result of fluid pressure changes in the tool housing generated by the movement of the pilot valve.

5. The downhole tool of claim 1, wherein the pilot valve is a rotary valve.

6. The downhole tool of claim 1, wherein the flow detection module and motor control module are part of a single control circuit.

7. The downhole tool of claim 1, wherein the flow detection module includes an accelerometer and the flow detection module is programmed to use the accelerometer to produce the operating signal in response to the sensed fluid flow characteristics where the sensed fluid flow characteristics include vibrations in the fluid flowing through the downhole tool.

8. A downhole tool comprising:

a tool housing having first and second ends and configured for attachment within a drill string;

a fluid passageway extending from the first end to the second end of the tool housing;

a fluid flow control valve positioned within the fluid passageway and movable between an open and a closed position, the fluid flow control valve configured to permit unmodulated flow of a fluid through the fluid passageway when in the open position;

a pilot valve operably associated with the fluid flow control valve and movable between an open position in which flow through the pilot valve is permitted to a closed position in which no flow is permitted through the pilot valve;

a motor connected to the pilot valve; and a motor control module programmed to manage operation of the motor and thereby move the pilot valve between the open and closed positions thereof, wherein movement of the pilot valve between the open and closed positions thereof moves the fluid flow control valve between the open and closed positions thereof.

9. The downhole tool of claim 8, wherein the fluid flow control valve is a poppet valve.

10. The downhole tool of claim 9, wherein the pilot valve is a rotary valve.

11. The downhole tool of claim 9, the poppet valve comprising a poppet mandrel and a poppet head, wherein the poppet head reciprocates on the poppet mandrel between open and closed positions solely as a result of fluid pressure changes in the tool housing generated by the movement of the pilot valve.

12. The downhole tool of claim 9, wherein fluid flow is diverted around the poppet head and into an annulus between the tool housing and the poppet valve when the poppet valve is in the closed position.

13. The downhole tool of claim 8, further comprising a flow detection module programmed to provide an operating mode signal to the motor control module, wherein the motor control module receives the operating mode signal and is programmed to control the movement of the pilot valve in response to the operating mode signal.

14. The downhole tool of claim 8, wherein the flow detection module includes an accelerometer and the flow detection module is programmed to use the accelerometer to produce the operating mode signal in response to sensed fluid flow characteristics of the fluid passing through the fluid passageway, where the sensed fluid characteristics include vibrations in the fluid flowing through the downhole tool.

15. The downhole tool of claim 8, wherein the downhole tool oscillates as a result of the movement of the fluid flow control valve between open and closed positions.

16. A downhole tool comprising:

a tool housing having first and second ends and configured for attachment within a drill string;

a fluid passageway extending from the first end to the second end of the downhole tool;

a poppet valve positioned within the fluid passageway and movable between an open and a closed position in response to operation of the motor, the poppet valve configured to permit unmodulated flow of a fluid through the fluid passageway when in the open position;

a pilot valve disposed in the tool housing and movable between an open position in which fluid flow is permitted therethrough and a closed position in which no fluid flow is permitted therethrough;

a motor operable to move the pilot valve between open and closed positions; and a motor control programmed to manage operation of the motor to control movement of the pilot valve between the open and closed positions, wherein the pilot valve is operable to move the poppet valve between the open and closed positions thereof.

17. The downhole tool of claim 16, further comprising a flow detection module programmed to provide an operating mode signal to the motor control module, wherein the motor control module receives the operating mode signal and is programmed to control the movement of the pilot valve in response to the operating mode signal.

18. The downhole tool of claim 16, wherein the poppet valve moves between open and closed positions solely as a result of fluid pressure changes in the tool housing generated by the movement of the pilot valve.

* * * * *